US011118595B2

(12) United States Patent
Lin et al.

(10) Patent No.: US 11,118,595 B2
(45) Date of Patent: Sep. 14, 2021

(54) VOLUTE ASSEMBLY AND INDUCED DRAFT FAN COMPRISING THE SAME

(71) Applicant: Zhongshan Broad-Ocean Motor Co., Ltd., Zhongshan (CN)

(72) Inventors: Yanhu Lin, Zhongshan (CN); Miao Zhang, Zhongshan (CN); Wei Lei, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 22 days.

(21) Appl. No.: 16/729,325

(22) Filed: Dec. 28, 2019

(65) Prior Publication Data

US 2021/0115937 A1 Apr. 22, 2021

Related U.S. Application Data

(63) Continuation-in-part of application No. PCT/CN2019/119818, filed on Nov. 21, 2019.

(30) Foreign Application Priority Data

Oct. 17, 2019 (CN) ..... 201921738810.1

(51) Int. Cl.
*F04D 29/08* (2006.01)
*F04D 17/10* (2006.01)

(52) U.S. Cl.
CPC ..... *F04D 29/083* (2013.01); *F04D 17/10* (2013.01)

(58) Field of Classification Search
CPC ..... F04D 29/4233; F04D 13/06; F04D 17/16; F04D 29/422; F23L 17/005
See application file for complete search history.

(56) References Cited

U.S. PATENT DOCUMENTS 3,758,227 A * 9/1973 Pollak ..... F04D 29/445 415/182.1
4,509,965 A * 4/1985 Morton ..... B01D 45/16 55/399
4,789,301 A * 12/1988 Osborne ..... F04D 29/445 29/527.6
5,997,246 A * 12/1999 Humbad ..... F04D 29/667 415/119

(Continued)

FOREIGN PATENT DOCUMENTS

CN 1788168 A 6/2006
CN 104564828 A 4/2015

(Continued)

OTHER PUBLICATIONS

CN 209672407 U English Translation (Year: 2019).*

*Primary Examiner* — Shafiq Mian
(74) *Attorney, Agent, or Firm* — Matthias Scholl P.C.; Matthias Scholl

(57) ABSTRACT

A volute assembly including a volute and a cover plate. The volute includes a cavity. The cover plate is disposed on the volute and covers the cavity. The cover plate includes an air inlet; the volute includes an exhaust duct. The exhaust duct includes an air outlet. The exhaust duct includes a first part, a second part, and a third part sequentially connected in that order. The first part is directly connected to the volute. The air outlet is disposed on the third part. The inner diameter of the second part increases in the direction from the first part to the third part.

11 Claims, 12 Drawing Sheets

(56) References Cited

U.S. PATENT DOCUMENTS

| | | | | |
|---|---|---|---|---|
| 6,511,290 | B1 * | 1/2003 | Gatley, Jr. | F04D 29/4226 285/322 |
| 2002/0192076 | A1 * | 12/2002 | Hansen | F02B 37/02 415/184 |
| 2008/0131283 | A1 * | 6/2008 | Elsaesser | F23D 14/02 416/247 R |
| 2014/0050576 | A1 * | 2/2014 | Li | F04D 29/4206 415/204 |
| 2019/0085863 | A1 * | 3/2019 | Lin | F04D 29/706 |

FOREIGN PATENT DOCUMENTS

| | | | |
|---|---|---|---|
| CN | 207500160 | U | 6/2018 |
| CN | 208503110 | U | 2/2019 |
| CN | 208686654 | U | 4/2019 |
| CN | 209672407 | U * | 11/2019 |
| JP | 2000104969 | A | 4/2000 |

* cited by examiner

VOLUTE ASSEMBLY AND INDUCED DRAFT FAN COMPRISING THE SAME

CROSS-REFERENCE TO RELATED APPLICATIONS

This application is a continuation-in-part of International Patent Application No. PCT/CN2019/119818 with an international filing date of Nov. 21, 2019, designating the United States, now pending, and further claims foreign priority benefits to Chinese Patent Application No. 201921738810.1 filed Oct. 17, 2019. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a volute assembly and an induced draft fan comprising the same.

Conventionally, a volute assembly includes a volute and a cover plate. The volute includes an exhaust duct consisting of an inner pipe and an outer pipe. A water storage cavity is disposed between the inner pipe and the outer pipe. The inner pipe is directly connected to the wall of the volute. The outer pipe includes a drain hole communicating with the water storage cavity. The arrangement of the inner pipe and the outer pipe leads to the difficulty of the injection molding of the volute.

SUMMARY

Provided is a volute assembly comprising a volute and a cover plate. The volute comprises a cavity. The cover plate is disposed on the volute and covers the cavity. The cover plate comprises an air inlet; the volute comprises an exhaust duct; the exhaust duct comprises an air outlet; the exhaust duct comprises a first part, a second part, and a third part sequentially connected in that order; the first part is directly connected to the volute; the air outlet is disposed on the third part; and the inner diameter D1 of the second part increases in the direction from the first part to the third part.

The third part comprises an inner wall provided with an annular flange; and an inner diameter D3 of the annular flange is larger than a maximum inner diameter of the second part.

The third part comprises an outer wall provided with a first flange, a second flange, and a locating slot disposed between the first flange and the second flange; the first flange is disposed on one end of the third part and surrounds the air outlet; the third part further comprises a slit extending from the first flange and the second flange.

At least one drain hole is disposed on the joint of the second part and the third part.

The inner wall of the second part is sunken towards the at least one drain hole to form a guide channel.

One side of the guide channel facing the air outlet is provided with a third flange for preventing water from entering the first part.

Also provided is an induced draft fan comprising the aforesaid volute assembly, a motor comprising a rotating shaft, and a wind blade; the front end of the rotating shaft of the motor extends into the cavity of the volute assembly and is directly connected to the wind blade.

The third part is provided with a conversion interface, and a seal ring is disposed between the conversion interface and the third part; a hose clamp is disposed on the locating slot of the third part; and the third part, the seal ring and the conversion interface are interlocked by the hose clamp.

The third part comprises an inner wall provided with an annular flange; an inner diameter D3 of the annular flange, a maximum inner diameter D0 of the second part, and an inner diameter D2 of the conversion interface satisfy the following inequality: D3>D2>D0; and the seal ring or the conversion interface abuts on the annular flange.

DETAILED DESCRIPTIONS

Figure 1:
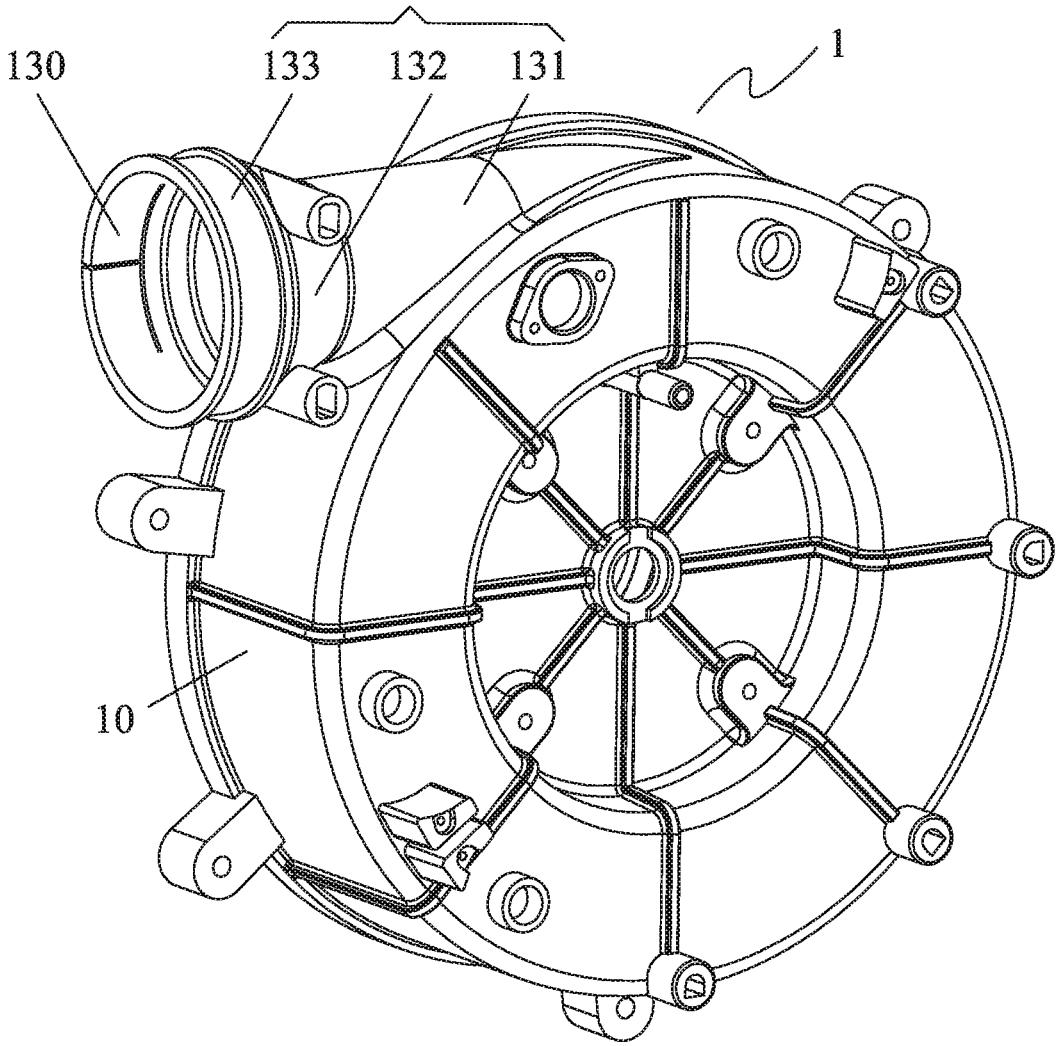
FIG. 1 is a stereogram of a volute assembly according to one embodiment of the disclosure.
Figure 2:
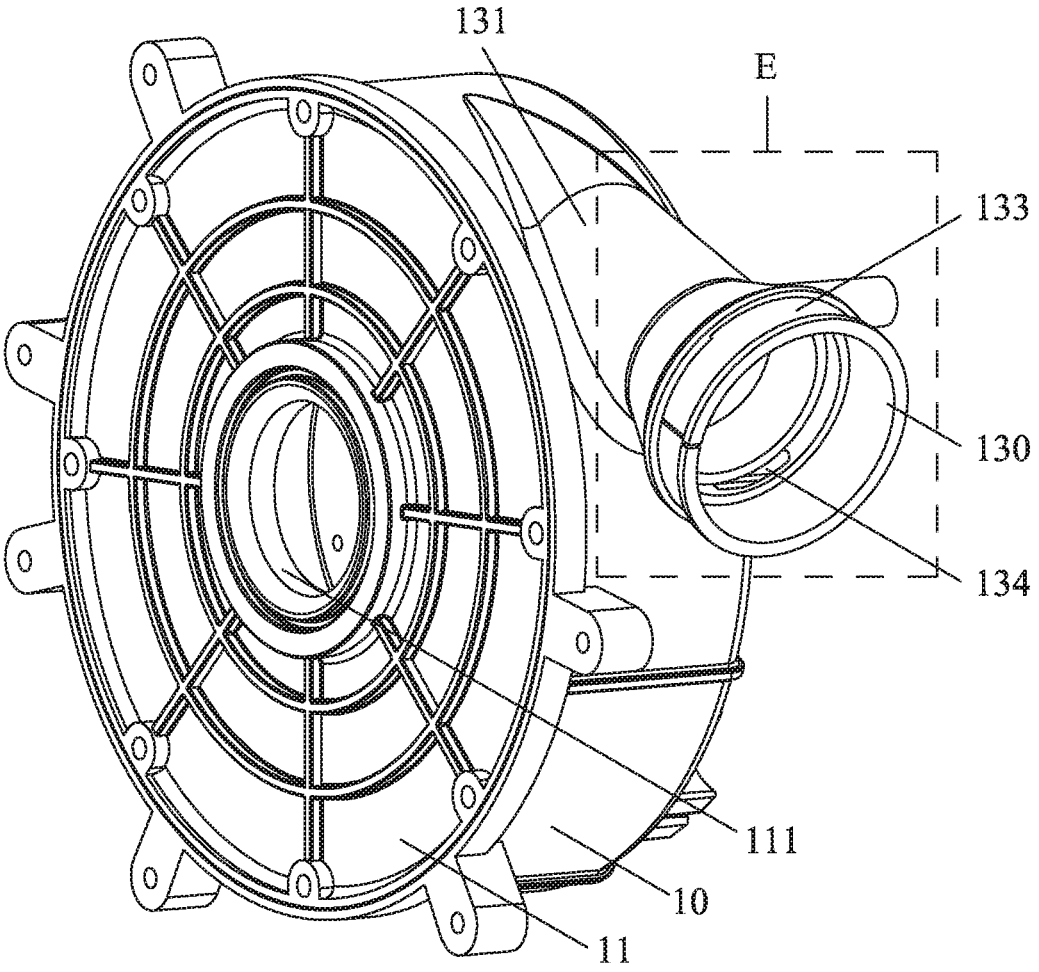
FIG. 2 is another stereogram of a volute assembly according to one embodiment of the disclosure.
Figure 3:
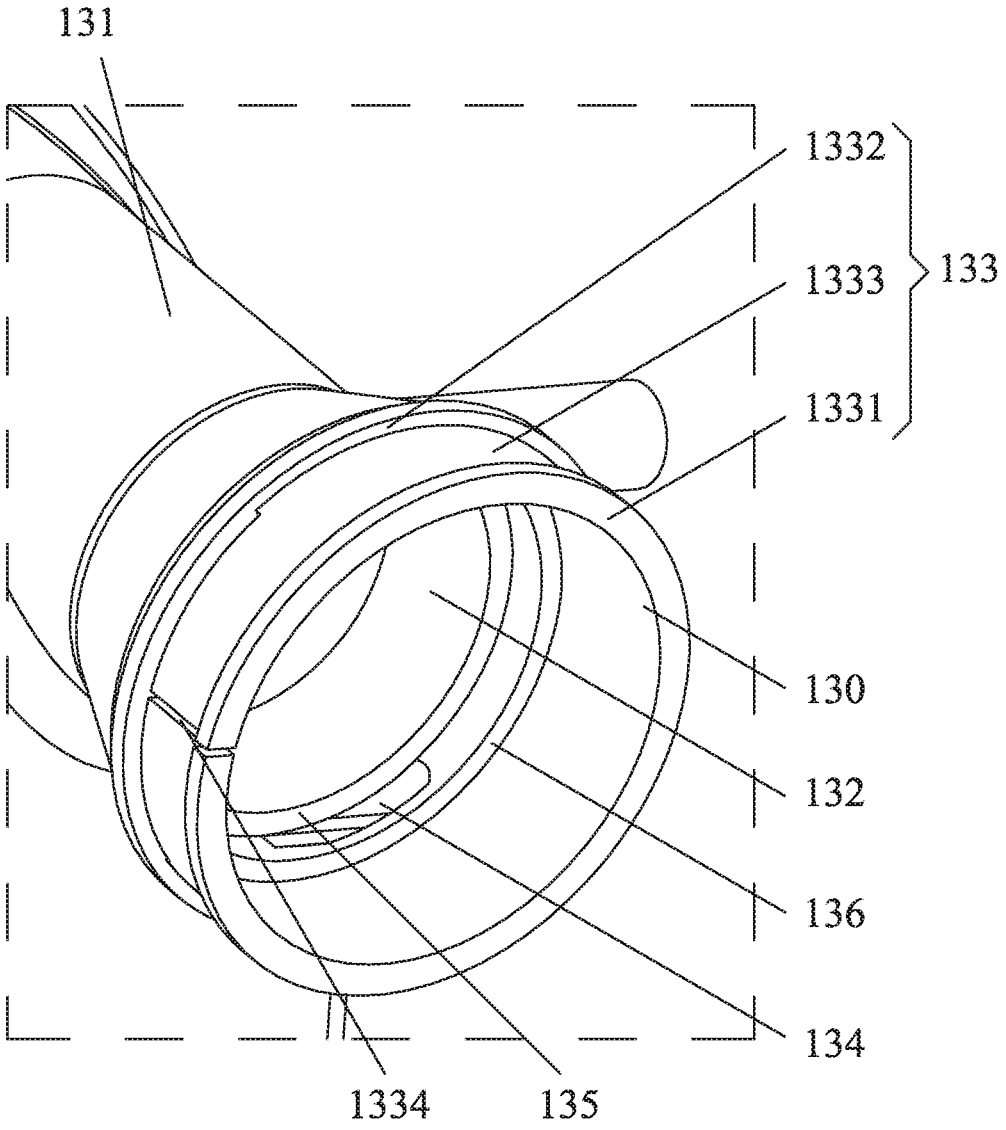
FIG. 3 is an enlarged view of part E in FIG. 2.
Figure 4:
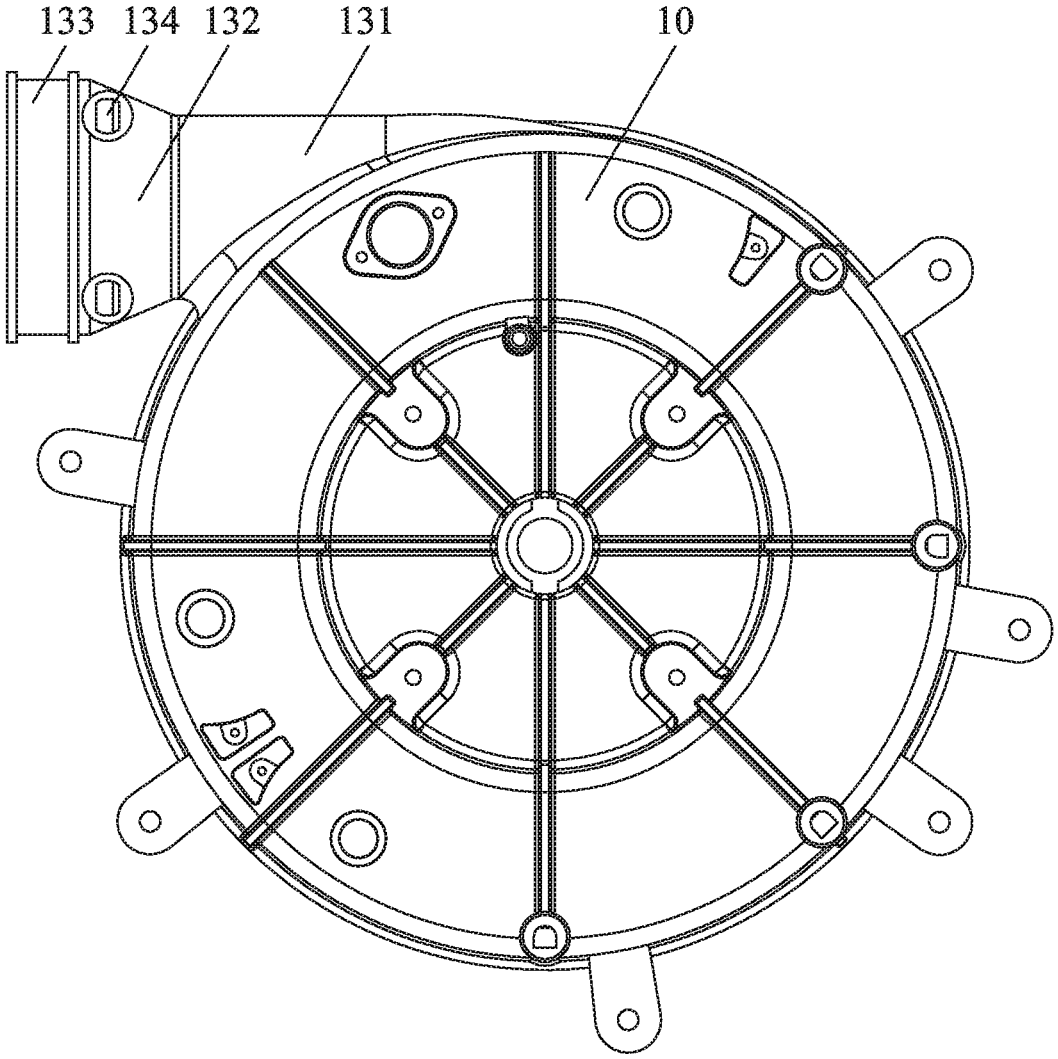
FIG. 4 is a front view of a volute assembly according to one embodiment of the disclosure.
Figure 5:
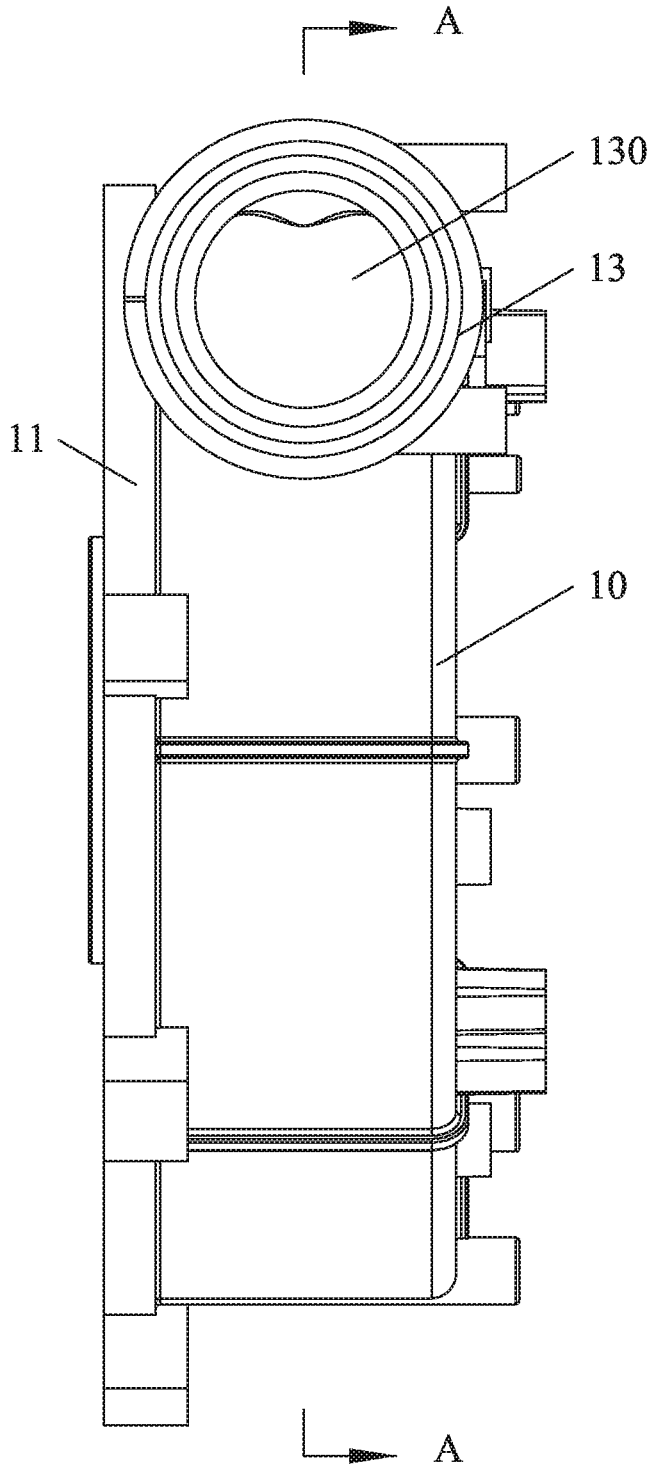
FIG. 5 is a left view of a volute assembly according to one embodiment of the disclosure.
Figure 6:
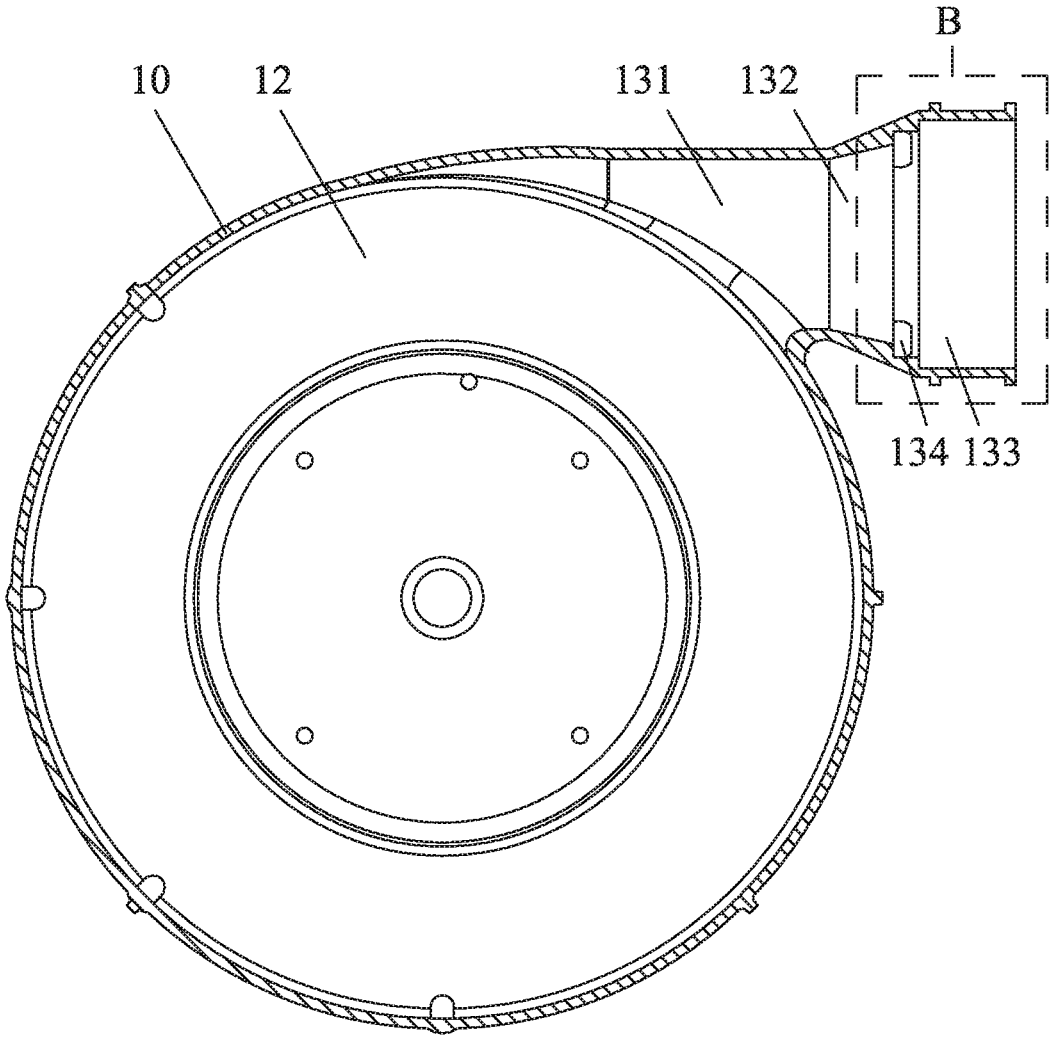
FIG. 6 is a sectional view taken from line A-A in FIG. 5.
Figure 7:
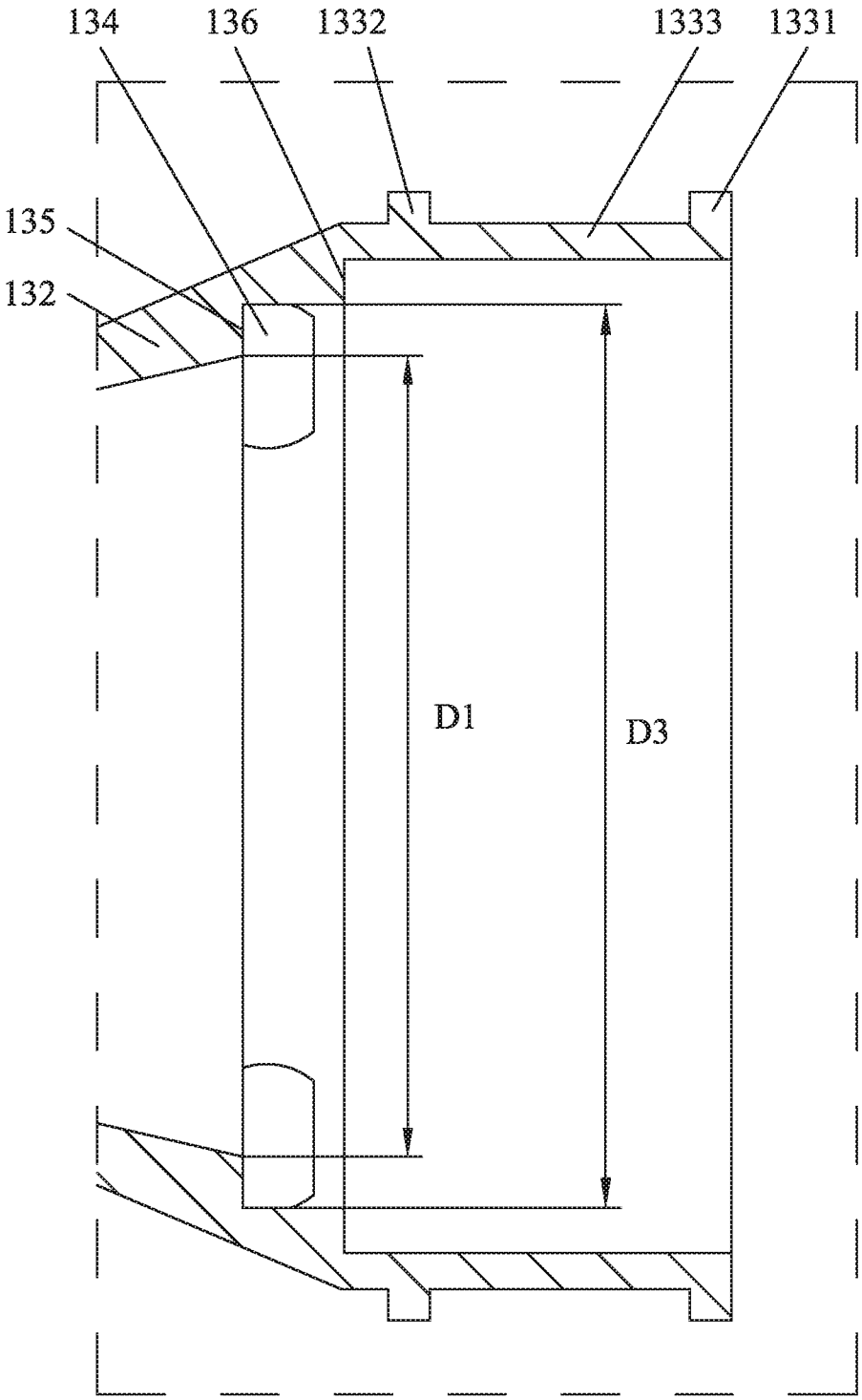
FIG. 7 is an enlarged view of part B in FIG. 6.

To further illustrate, embodiments detailing a volute assembly and an induced draft fan comprising the same are described below. It should be noted that the following embodiments are intended to describe and not to limit the disclosure.

EXAMPLE 1

As shown in FIGS. 1-7, a volute assembly comprises a volute 10 and a cover plate 11. The volute comprises a cavity 12; the cover plate 11 is disposed on the volute 10 and covers the cavity 12. The cover plate 11 comprises an air inlet 111; the volute 10 comprises an exhaust duct 13; the exhaust duct 13 comprises an air outlet 130; the exhaust duct 13 comprises a first part 131, a second part 131, and a third part 133 sequentially connected in that order; the first part 131 is directly connected to the volute 10; the air outlet 130 is disposed on the third part 133; and the second part 132 is conical, and an inner diameter D1 of the second part 132 increases in a direction from the first part 131 to the third part 133.

The exhaust duct of the volute is not divided into an inner pipe and an outer pipe. This reduces the difficulty and cost of injection molding, and extends the service life of the volute mold. The dimensions of the air outlet 130 remain unchanged, and the volute assembly can be compatible with conventional conversion interfaces. According to Bernoulli's principle, the gradual increase of the inner diameter D1 of the second part 132 from the first part 131 to the third part 133 can make the wind speed in the exhaust duct 13 gradually decrease, and the pressure will gradually increase, which can reduce the loss of the air flow due to the sudden increase of the air outlet area, and also reduce the noise produced in the process of sudden expansion of the pressure.

The third part 133 comprises an inner wall provided with an annular flange 136; and the inner diameter D3 of the annular flange 136 is larger than the maximum inner diameter of the second part 132. The annular flange 136 is configured to limit the mounting position of a conversion interface.

The third part 133 comprises an outer wall provided with a first flange 1331, a second flange 1332, and a locating slot 1333 disposed between the first flange 1331 and the second flange 1332; the first flange 1331 is disposed on one end of the third part 133 and surrounds the air outlet 130; the third part 133 fluffier comprises a slit 1334 extending from the first flange 1331 and the second flange 1332.

At least one drain hole 134 is disposed on a joint of the second part 132 and the third part 133. When condensate water is generated, the condensate water can be discharged out of the volute assembly from the drain hole 134.

The inner wall of the second part 132 is sunken towards the at least one drain hole 134 to form a guide channel 135. The condensate water can flow to the drain hole along the guide channel 135, which produces good drainage effect.

EXAMPLE 2

Figure 8:
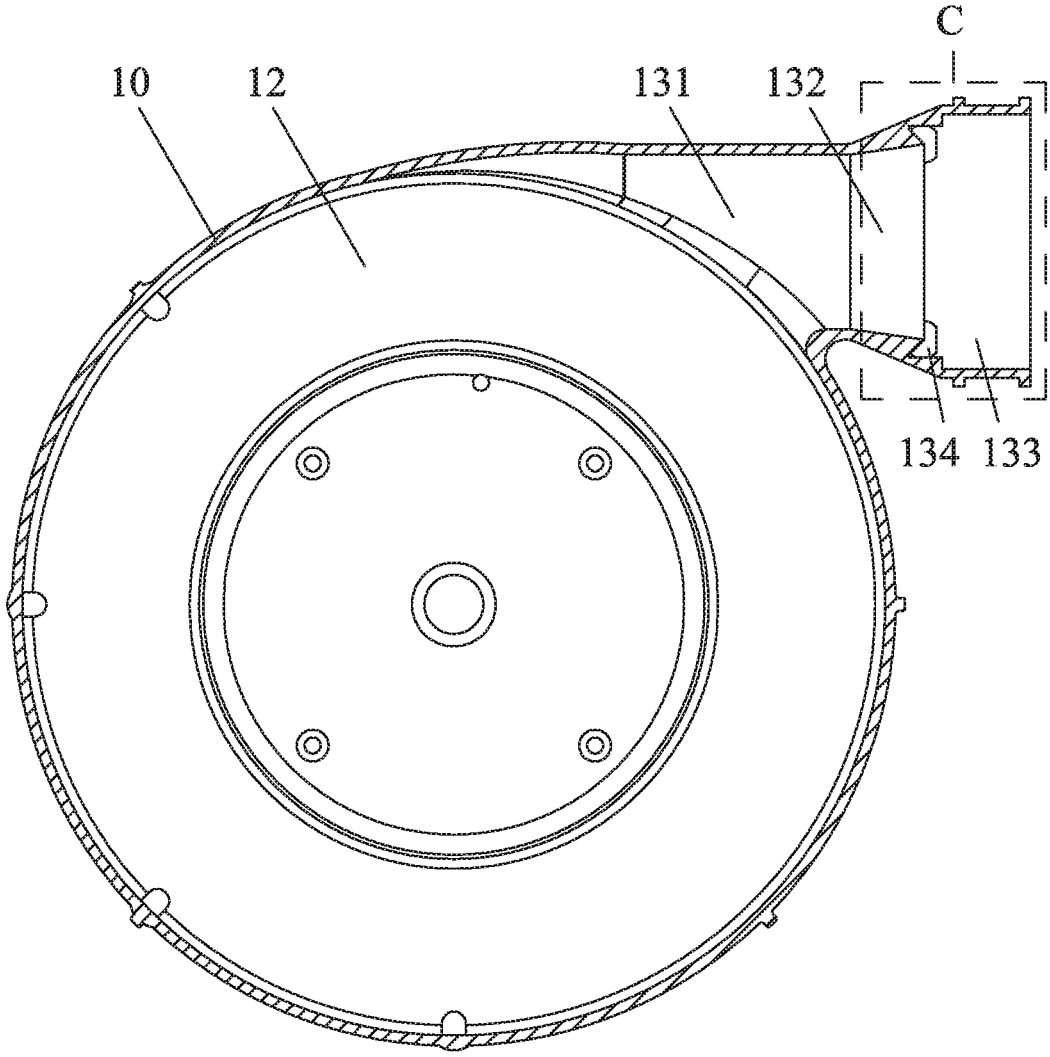
FIG. 8 is a sectional view of a volute assembly according to one embodiment of the disclosure.
Figure 9:
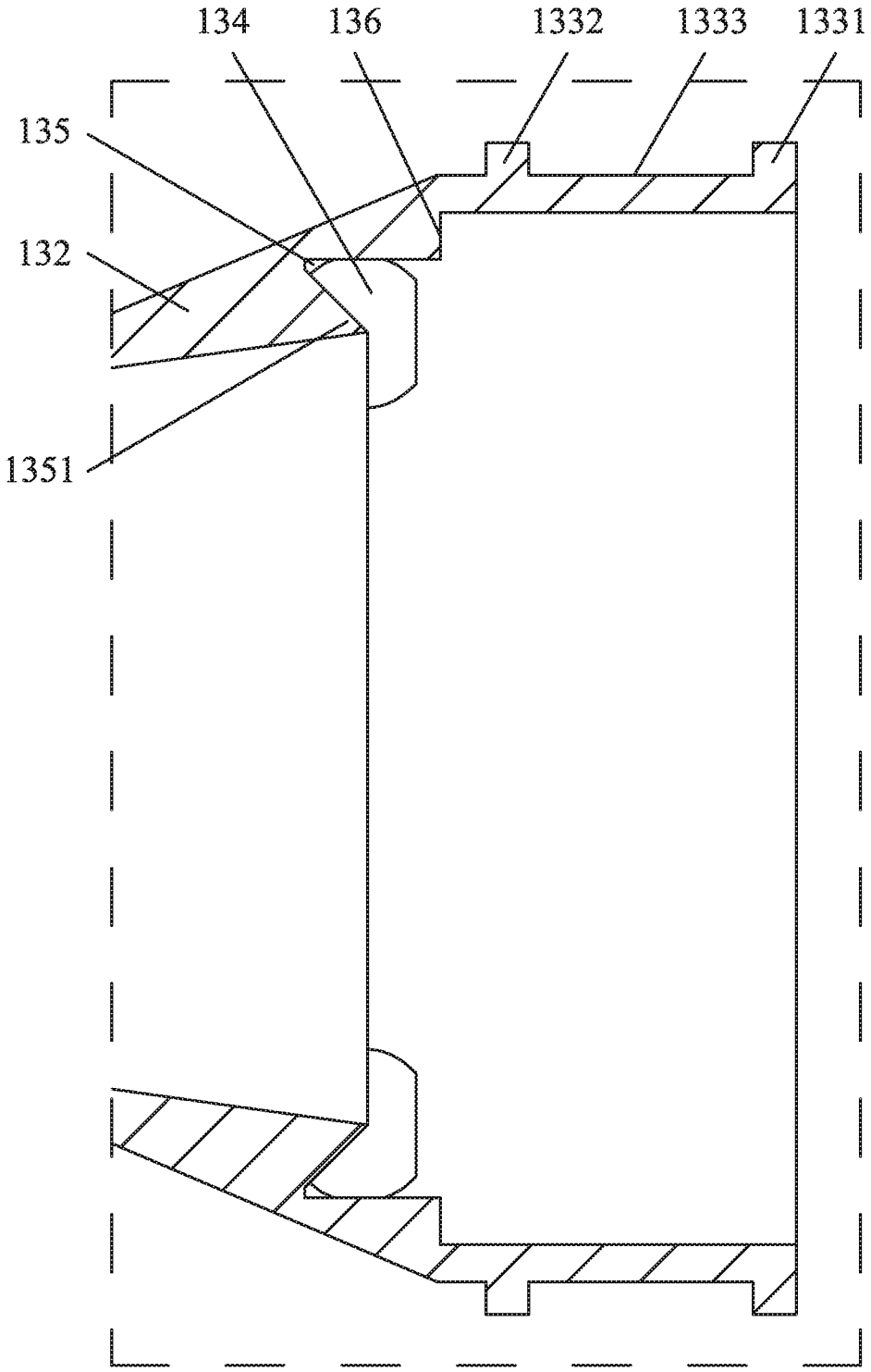
FIG. 9 is an enlarged view of part C in FIG. 8.

As shown in FIGS. 8-9, the volute assembly is basically the same as that in Example 1 except that: one side of the guide channel 135 facing the air outlet 130 is provided with a third flange 1351 having a V-shaped or U-shaped section, which is configured to prevent the condensate water from entering the first part 131.

EXAMPLE 3

Figure 10:
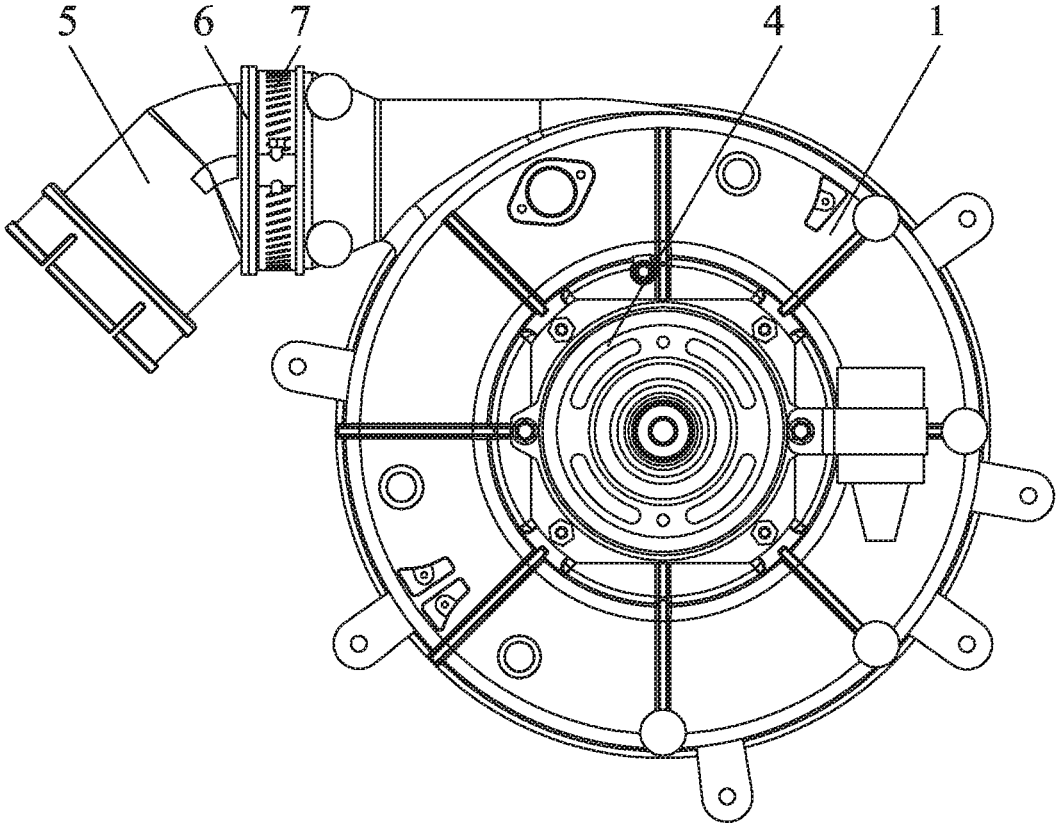
FIG. 10 is a stereogram of an induced draft fan according to one embodiment of the disclosure.
Figure 11:
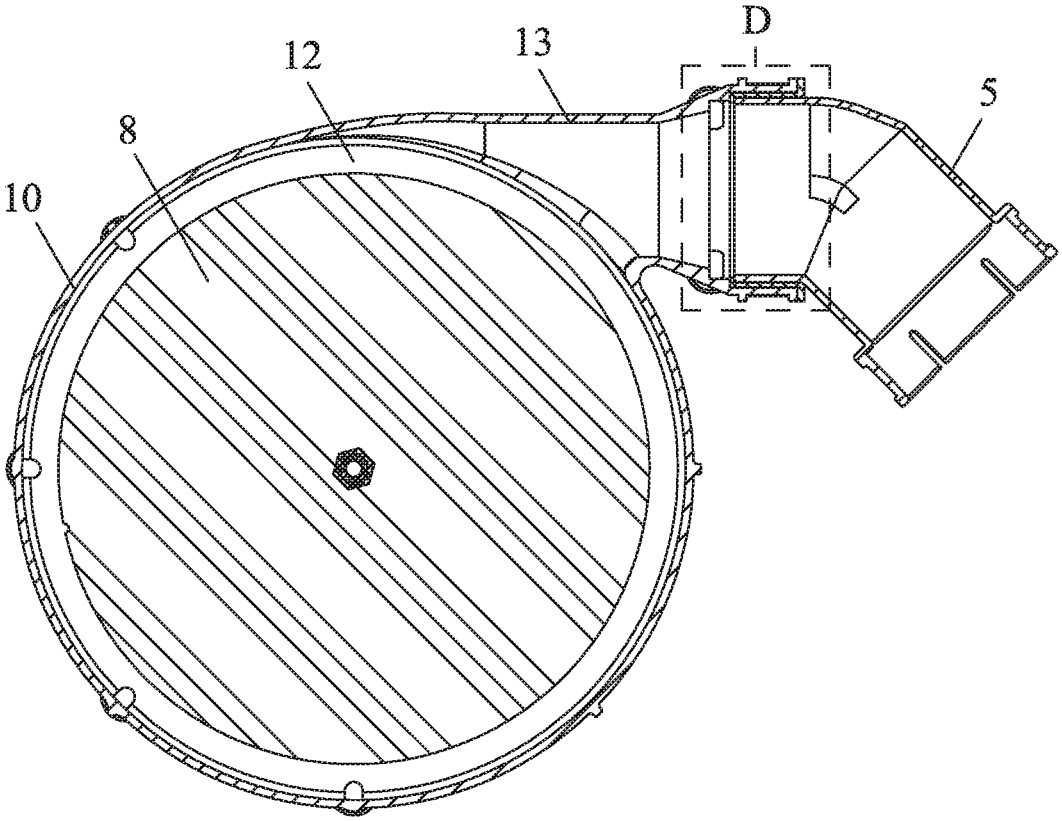
FIG. 11 is a section view of an induced draft fan according to one embodiment of the disclosure.
Figure 12:
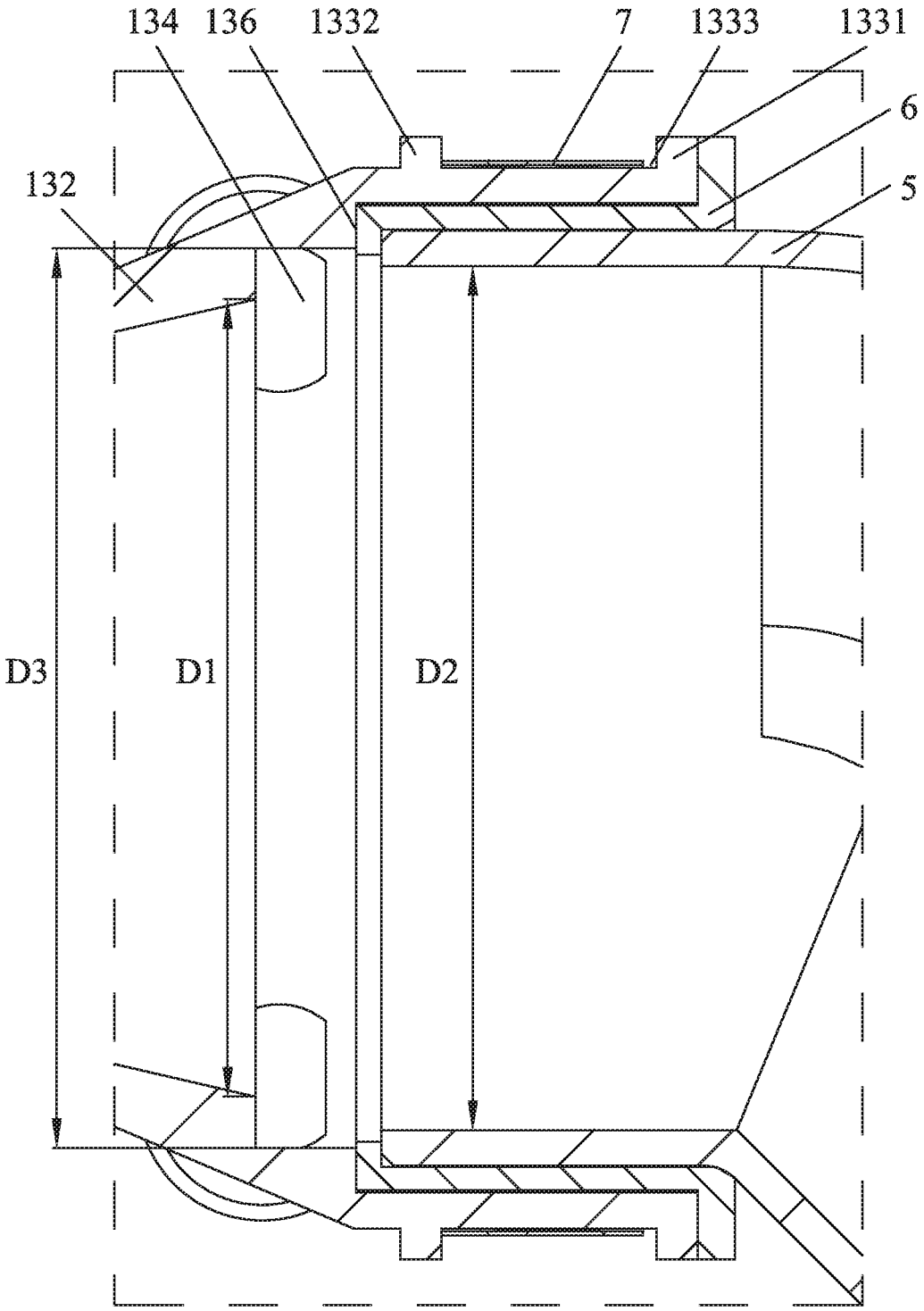
FIG. 12 is an enlarged view of part D in FIG. 11.

As shown in FIGS. 10-12, an induced draft fan comprises a volute assembly in Example 1 or 2, a motor 4 comprising a rotating shaft, and a wind blade 8; the front end of the rotating shaft of the motor 4 extends into the cavity 12 of the volute assembly 1 and is directly connected to the wind blade 8.

The third part 133 is provided with a conversion interface 5, and a seal ring 6 is disposed between the conversion interface 5 and the third part 133; a hose clamp 7 is disposed on the locating slot of the third part 133; and the third part 133, the seal ring 6 and the conversion interface 5 are interlocked by the hose clamp 7.

The third part 133 comprises an inner wall provided with an annular flange 136; an inner diameter D3 of the annular flange 136, a maximum inner diameter D0 of the second part 132, and an inner diameter D2 of the conversion interface 5 satisfy the following inequality: D3>D2>D0; and the seal ring 6 or the conversion interface 5 abuts on the annular flange 136.

It will be obvious to those skilled in the art that changes and modifications may be made, and therefore, the aim in the appended claims is to cover all such changes and modifications.

What is claimed is:

1. A volute assembly, comprising:

1) a volute, the volute comprising a cavity; and 2) a cover plate disposed on the volute and covering the cavity;

wherein:

the cover plate comprises an air inlet;

the volute comprises an exhaust duct; the exhaust duct comprises an air outlet;

the exhaust duct comprises a first part, a second part, and a third part sequentially connected in that order; the first part is directly connected to the volute;

the air outlet is disposed on the third part;

an inner diameter D1 of the second part increases in a direction from the first part to the third part;

the third part comprises an inner wall provided with an annular flange; and an inner diameter D3 of the annular flange is larger than a maximum inner diameter of the second part.

2. A volute assembly, comprising:

a volute, the volute comprising a cavity; and a cover plate disposed on the volute and covering the cavity;

wherein:

the cover plate comprises an air inlet;

the volute comprises an exhaust duct; the exhaust duct comprises an air outlet;

the exhaust duct comprises a first part, a second part, and a third part sequentially connected in that order; the first part is directly connected to the volute;

the air outlet is disposed on the third part;

an inner diameter D1 of the second part increases in a direction from the first part to the third part;

the third part comprises an inner wall provided with an annular flange; and an inner diameter D3 of the annular flange is larger than a maximum inner diameter of the second part; and the third part comprises an outer wall provided with a first flange, a second flange, and a locating slot disposed between the first flange and the second flange; the first flange is disposed on one end of the third part and surrounds the air outlet; the third part further comprises a slit extending from the first flange and the second flange.

3. The volute assembly of claim 1, wherein at least one drain hole is disposed between the second part and the third part.

4. The volute assembly of claim 2, wherein at least one drain hole is disposed between the second part and the third part.

5. The volute assembly of claim 3, wherein an inner wall of the second part is sunken towards the at least one drain hole to form a guide channel.

6. The volute assembly of claim 4, wherein an inner wall of the second part is sunken towards the at least one drain hole to form a guide channel.

7. The volute assembly of claim 5, wherein one side of the guide channel facing the air outlet is provided with a third flange for preventing water from entering the first part.

8. The volute assembly of claim 6, wherein one side of the guide channel facing the air outlet is provided with a third flange for preventing water from entering the first part.

9. An induced draft fan, comprising a volute assembly of claim 1, a motor comprising a rotating shaft, and a wind blade; wherein a front end of the rotating shaft of the motor extends into the cavity of the volute assembly and is directly connected to the wind blade.

10. An induced draft fan, comprising a volute assembly, a motor comprising a rotating shaft, and a wind blade;

wherein:

the volute assembly comprises a volute and a cover plate;

the volute comprises a cavity;

the cover plate is disposed on the volute and covers the cavity;

the cover plate comprises an air inlet;

the volute comprises an exhaust duct; the exhaust duct comprises an air outlet;

the exhaust duct comprises a first part, a second part, and a third part sequentially connected in that order; the first part is directly connected to the volute;

the air outlet is disposed on the third part;

an inner diameter D1 of the second part increases in a direction from the first part to the third part;

a front end of the rotating shaft of the motor extends into the cavity of the volute assembly and is directly connected to the wind blade; and the third part is provided with a conversion interface, and a seal ring is disposed between the conversion interface and the third part; a hose clamp is disposed on the locating slot of the third part; and the third part, the seal ring and the conversion interface are interlocked by the hose clamp.

11. The fan of claim 10, wherein the third part comprises an inner wall provided with an annular flange; an inner diameter D3 of the annular flange, a maximum inner diameter D0 of the second part, and an inner diameter D2 of the conversion interface satisfy the following inequality: D3>D2>D0; and the seal ring or the conversion interface abuts on the annular flange.

* * * * *